US011649627B2

(12) United States Patent
Heitsman et al.

(10) Patent No.: US 11,649,627 B2
(45) Date of Patent: May 16, 2023

(54) LAMINATED LUMBER CONSTRUCTED VOLUMETRIC MODULAR UNIT FOR MODULAR BUILDING CONSTRUCTION

(71) Applicant: Best GEN Modular, Inc., Rapid City, SD (US)

(72) Inventors: Michael Heitsman, Kansas City, MO (US); Jay Christenson, Watertown, SD (US)

(73) Assignee: BEST GEN MODULAR, INC., Rapid City, SD (US)

( * ) Notice: Subject to any disclaimer, the term of this patent is extended or adjusted under 35 U.S.C. 154(b) by 0 days.

(21) Appl. No.: 16/934,806

(22) Filed: Jul. 21, 2020

(65) Prior Publication Data

US 2022/0025640 A1 Jan. 27, 2022

(51) Int. Cl.
*E04B 1/348* (2006.01)

(52) U.S. Cl.
CPC ..... *E04B 1/34838* (2013.01)

(58) Field of Classification Search
CPC .... E04B 1/34838; E04B 1/26; E04B 1/34321; E04B 1/3483; E04B 1/24; E04B 5/14; E04B 1/3445; E04B 2001/34389; E04C 2003/0491; E04H 1/005; E04H 1/1205
See application file for complete search history.

(56) References Cited

U.S. PATENT DOCUMENTS 2,564,691 A 8/1951 Alfred
3,540,173 A 11/1970 Johnides
4,807,407 A * 2/1989 Horn ..... E04B 1/24 52/125.2
5,218,801 A * 6/1993 Hereford ..... E04B 7/022 52/223.9
5,724,774 A 3/1998 Rooney
6,460,297 B1 * 10/2002 Bonds ..... E04C 2/384 52/234
8,082,718 B2 12/2011 Esbaum
9,169,631 B2 10/2015 Tate
9,702,138 B1 7/2017 Rutherford
10,196,809 B2 2/2019 Hall et al.
2004/0107651 A1 * 6/2004 Johnson ..... E04H 3/12 52/6
2010/0242405 A1 9/2010 Esbaum
2010/0325988 A1 * 12/2010 Poston ..... E04B 1/26 52/236.3
2011/0036022 A1 2/2011 Hsu et al.
(Continued)

*Primary Examiner* — Gisele D Ford
(74) *Attorney, Agent, or Firm* — Goodhue, Coleman & Owens, P.C.

(57) ABSTRACT

A laminated lumber constructed volumetric modular unit constructed at a modular unit factory and shipped assembled to a modular building project site is disclosed. The laminated lumber constructed volumetric modular unit includes a floor structure and ceiling structure interconnected by opposing side wall structures and opposing end wall structures, a plurality of floor trusses disposed within the floor structure, a plurality of ceiling trusses disposed within the ceiling structure, a plurality of wall studs disposed within the opposing side wall structures and opposing end wall structures, one or more rim joists attached to the ceiling structure, and one or more multiple laminated lumbers attached to the floor structure and extending between the opposing end wall structures for carrying the load of the modular unit.

14 Claims, 7 Drawing Sheets

(56) References Cited

U.S. PATENT DOCUMENTS

| | | | | |
|---|---|---|---|---|
| 2011/0173907 | A1 | 7/2011 | Katsalidis | |
| 2014/0137485 | A1 | 5/2014 | Lafferty, III et al. | |
| 2014/0260024 | A1 | 9/2014 | Tate | |
| 2014/0345217 | A1 | 11/2014 | Horton, III | |
| 2015/0322668 | A1 | 11/2015 | Quinn et al. | |
| 2016/0024779 | A1 | 1/2016 | Clus et al. | |
| 2016/0348369 | A1 | 12/2016 | Godfrey et al. | |
| 2017/0159290 | A1 | 6/2017 | Albright et al. | |
| 2017/0198489 | A1 | 7/2017 | Klein | |
| 2018/0355603 | A1 | 12/2018 | Hall et al. | |
| 2019/0234063 | A1 | 8/2019 | Ruiz | |
| 2019/0292770 | A1* | 9/2019 | Gordon | E04B 1/34321 |
| 2019/0376303 | A1 | 12/2019 | Wolff | |

* cited by examiner

LAMINATED LUMBER CONSTRUCTED VOLUMETRIC MODULAR UNIT FOR MODULAR BUILDING CONSTRUCTION

FIELD OF THE INVENTION

This disclosure relates to volumetric modular units used in modular building construction and reinforcing structures which may be integrated into such modules. More particularly, but not exclusively, the disclosure relates to a laminated lumber constructed modular unit for modular building construction.

BACKGROUND

Modular building construction is used to construct single floor to multi-floor projects. Multi-floor projects often include larger rooms with unsupported spans that require special supporting structure or components for supporting floors above. For example, a pool, recreational, dinning and reception area of a hotel often include such structure. Popular designs, esthetics and brands are increasingly limiting the amount of visible structural support, wanting an open, unobstructed view and ambience while exceeding design codes and building integrity requirements. Expensive structural components, such as laminated wood and steel beams, posts, girders and trusses, are often relied on for supporting structures. Unsupported spans, especially when supporting above floors, are a significant challenge for modular building construction.

SUMMARY

Therefore, what is needed is a reinforcing structure that increases the structural integrity and strength of a volumetric modular unit and modular unit constructed building, increases ease of module to module connections, wiring, and plumbing, and enables modules to span greater distances without support from below from non-module features, such as interior walls, columns, posts, piers, beams, girders, or trusses.

It is a primary object, feature, or advantage of the present disclosure to improve over and address limitations in the state of the art.

It is a further object, feature, or advantage of the present invention to provide a volumetric modular unit that does not require any additional or special supporting structures from beneath.

It is a still further object, feature, or advantage of the present invention to provide a volumetric modular unit having supporting structure fabricated into a floor structure of the module for traversing unsupported spans.

Another object, feature, or advantage is to provide a modular constructed building that includes one or more large rooms or spaces unobstructed by structural components, such as laminated wood and steel beams, posts, girders and trusses.

Yet another object, feature, or advantage is to provide a modular constructed building with one or more volumetric modular units traversing unsupported spans above a large open area.

Still another object, feature, or advantage is to provide a wall structure of a volumetric modular unit that is attached to a floor structure through one or multiple laminated lumbers.

According to one exemplary aspect of the disclosure, a laminated lumber constructed volumetric modular unit constructed at a modular unit factory and shipped assembled to a modular building project site is disclosed. The laminated lumber constructed volumetric modular unit includes a floor structure and ceiling structure interconnected by opposing side wall structures and opposing end wall structures, a plurality of floor trusses disposed within the floor structure, a plurality of ceiling trusses disposed within the ceiling structure, a plurality of wall studs disposed within the opposing side wall structures and opposing end wall structures, one or more rim joists attached to the ceiling structure, and one or more multiple laminated lumbers attached to the floor structure and extending between the opposing end wall structures for carrying the load of the modular unit.

According to one exemplary aspect of the disclosure, a modular building constructed from laminated lumber constructed volumetric modular unit is disclosed. The modular building includes a foundation with opposing foundation walls forming an open space extending entirely between the opposing foundation walls, a plurality of volumetric modular units assembled together on top of the foundation to provide the modular building having one or more floors with one or more rooms, at least one of the plurality of volumetric modular units having a floor structure and ceiling structure interconnected by opposing side wall structures and opposing end wall structures, a plurality of floor trusses disposed within the floor structure, a plurality of ceiling trusses disposed within the ceiling structure, a plurality of wall studs disposed within the opposing side wall structures and opposing end wall structures, one or more rim joists attached to the ceiling structure, and one or more multiple laminated lumbers attached to the floor structure and extending between the opposing end wall structures for carrying the load of the modular unit. A first supported end of the one or more multiple laminated lumbers is supported atop a first one of the opposing foundation walls and a second supported end of the one or more multiple laminated lumbers is supported atop a second one of the opposing foundation walls. An unsupported portion of the one or more multiple laminated lumbers extends between the first and second supported ends above the open space.

According to one exemplary aspect of the disclosure, a method for constructing a volumetric modular unit with laminated lumber at a modular unit factory for shipping assembled to a modular building project site and building a modular constructed building is disclosed. The method includes fabricating a floor structure from a plurality of floor trusses, fabricating a ceiling structure from a plurality of ceiling trusses, fabricating opposing side wall structures and opposing end wall structures from a plurality of wall studs, attaching one or more rim joists to the ceiling structure, and attaching one or more multiple laminated lumbers to the floor structure between the opposing end wall structures for carrying the load of the volumetric modular unit. In at least one aspect, the method includes, providing a foundation with opposing foundation walls forming an open space extending entirely between the opposing foundation walls at the modular building project site, assembling a plurality of volumetric modular units together on top of the foundation to provide the modular constructed building having one or more floors with one or more rooms, and supporting a first supported end of the one or more multiple laminated lumbers atop a first one of the opposing foundation walls and supporting a second supported end of the one or more multiple laminated lumbers atop a second one of the opposing foundation walls so that an unsupported portion of the one or more multiple laminated lumbers extends between the first and second supported ends above the open space.

One or more of these and/or other objects, features, or advantages of the disclosure will become apparent from the specification and claims that follow. No single aspect need provide each and every object, feature, or advantage. Different aspects may have different objects, features, or advantages. Therefore, the disclosure is not to be limited to or by any objects, features, or advantages stated herein.

BRIEF DESCRIPTION OF THE DRAWINGS

Illustrated embodiments of the disclosure are described in detail below with reference to the attached drawing figures, which are incorporated by reference herein.

DETAILED DESCRIPTION

Figure 1:
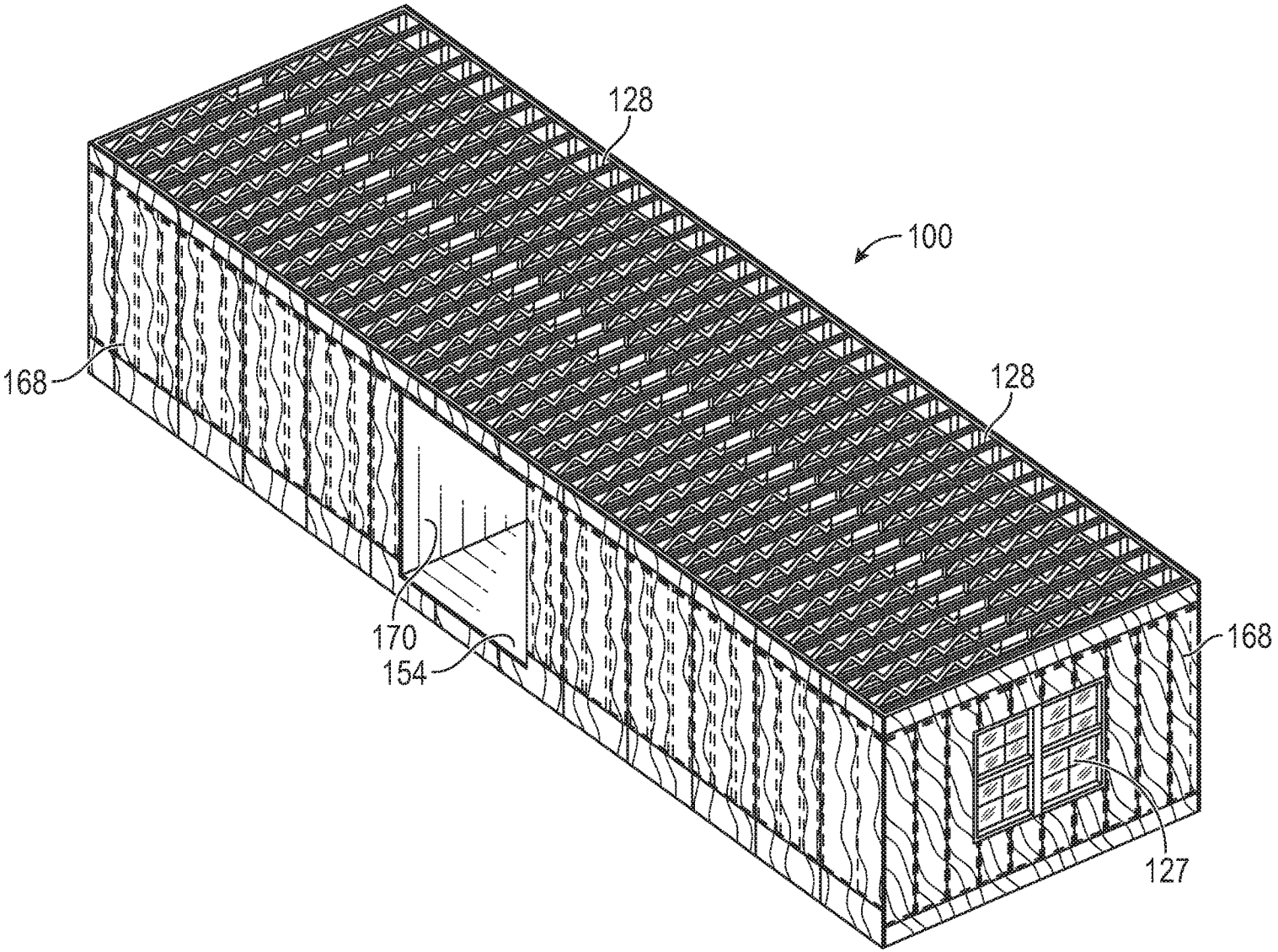
FIG. 1 is an isometric view of a volumetric modular unit in accordance with an illustrative aspect of the disclosure.
Figure 2:
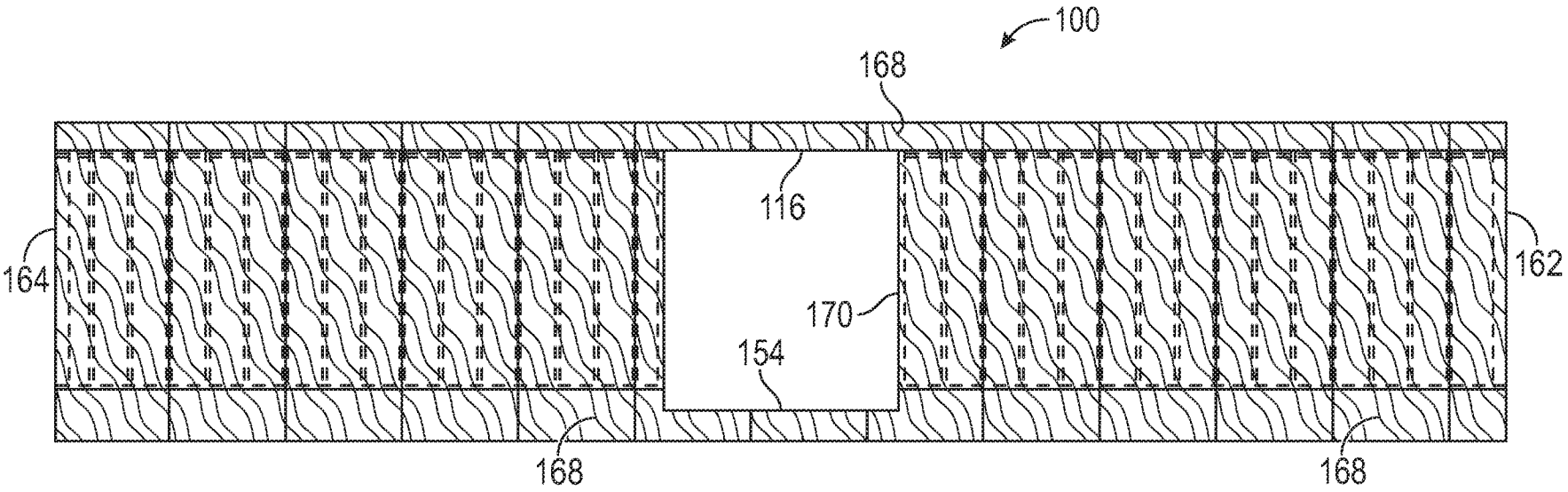
FIG. 2 is a side elevation view of the volumetric modular unit shown in FIG. 1.
Figure 3:
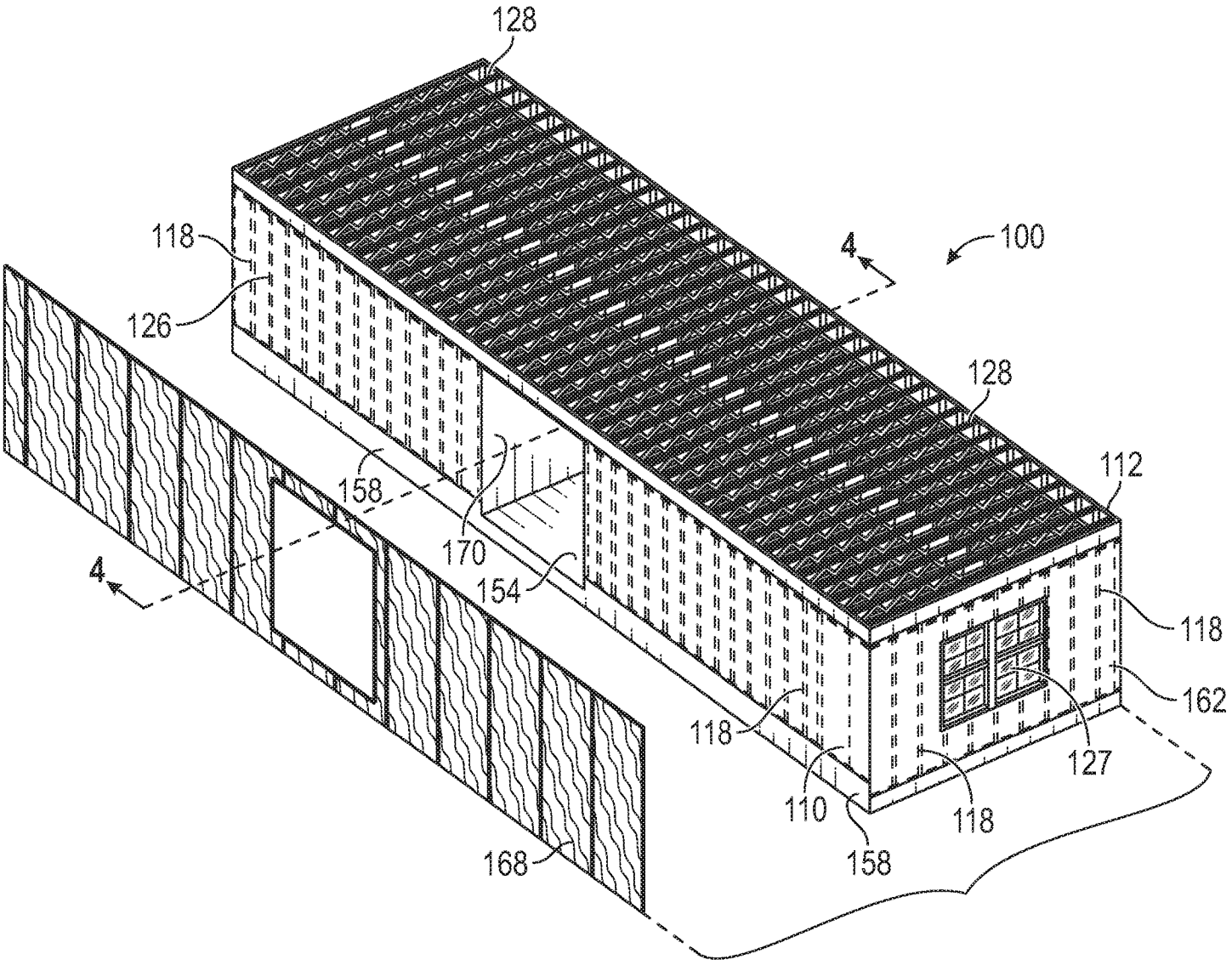
FIG. 3 is an isometric view of the volumetric modular unit shown in FIG. 1 with sheathing shown exploded for one side and removed from the other sides in accordance with an illustrative aspect of the disclosure.
Figure 4:
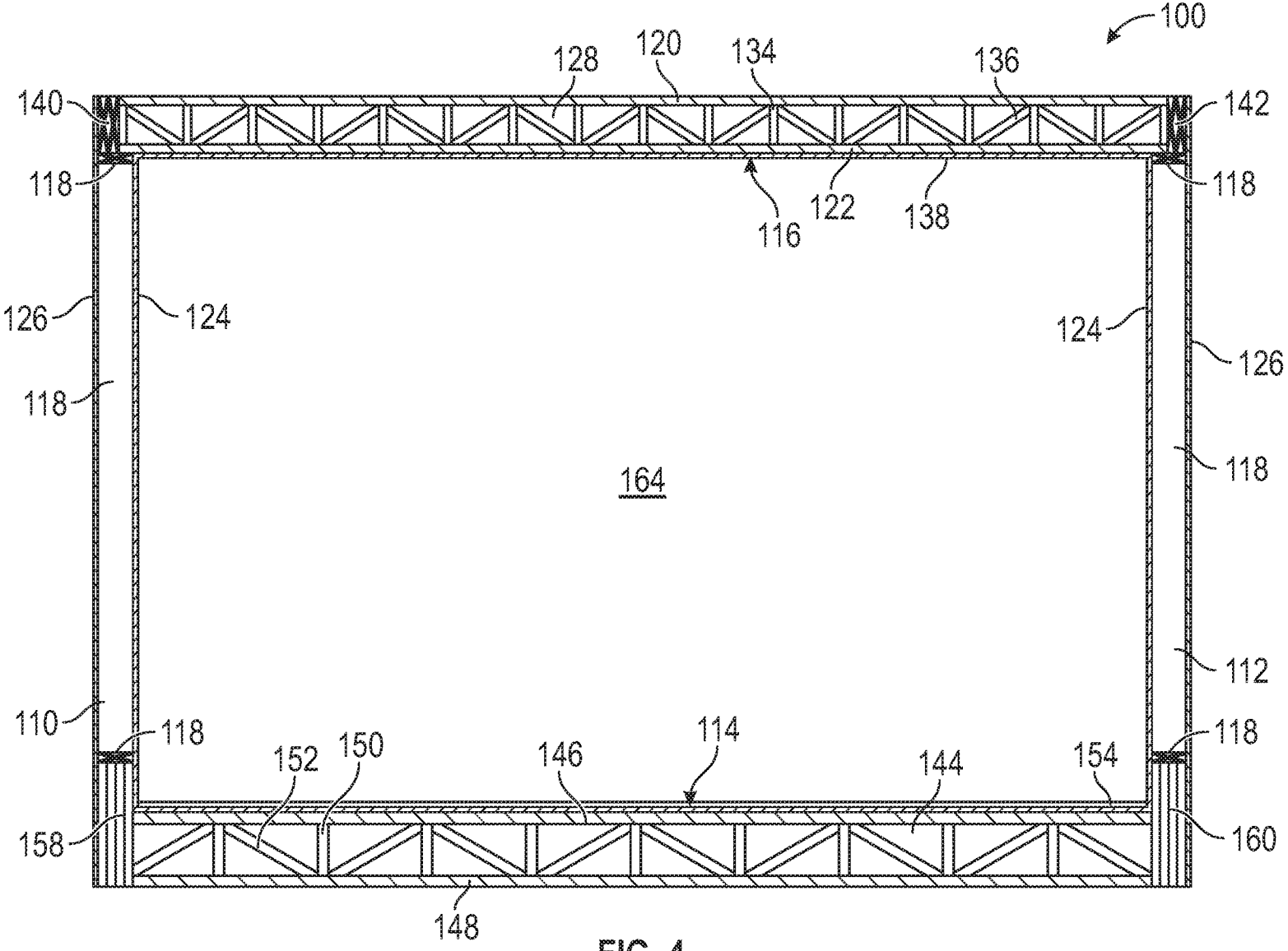
FIG. 4 is a cross-section view of the volumetric modular unit taken along line 4-4 in FIG. 3 illustrating reinforcing structure in the floor according to an exemplary aspect of the disclosure.
Figure 5:
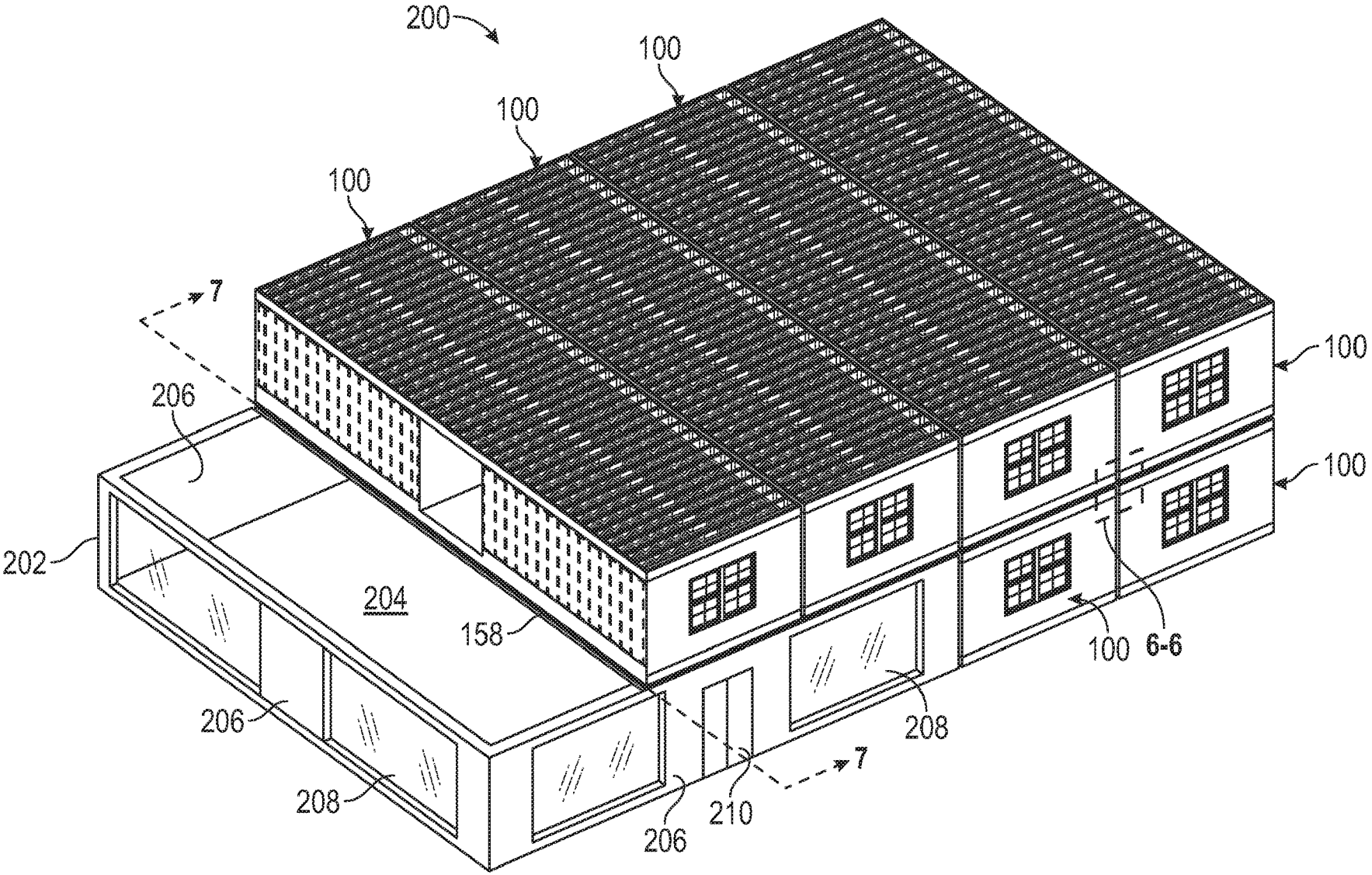
FIG. 5 is an isometric view of a modular constructed building with sheathing removed for illustrating in accordance with an exemplary aspect of the disclosure.

The disclosure provides volumetric modular units or modules used in modular building construction and reinforcing structures which may be integrated into the units/modules used in modular building construction. The reinforcing structures may be used to increase the structural integrity and strength of a volumetric modular unit and enable it to span greater distances without building framing and structural support from below, such as walls, columns, posts, piers, beams, girders, or trusses.

The modular building construction method utilizes "volumetric modular units," "modular units," "modulars," or "modules," as they are typically referred to within the industry, produced in a factory environment, transported to a project site, and together with other modular units and constructions materials are assembled into a final building configuration at a project or construction site. Each modular unit may include one or more habitable rooms in which the floor, walls, and ceiling are preassembled at a production facility for modular units, transported to the construction site, and then moved into their final position and fastened together before the exterior, facade or finishing touches of the modular constructed building are applied to the exterior, the adjoining interior spaces and the roof. The degree to which the modular units are finished at the production facility may vary, but can include installation, texturing, and painting of walls and ceilings; installation and finishing of doors, windows, and decorative trim; installation of carpet, tile, and other flooring; installation of lights, switches, outlets, plumbing, and HVAC (heating, ventilation, and air conditioning) systems; and installation of cabinets, counters and countertops, and even certain furniture and furnishings. In contrast, traditional site-built or stick-built construction requires delivering all of the necessary materials to the construction site where individual components and materials are fabricated and assembled into the final structure at the site, and specialized crews are hired to complete the installation of the aforementioned items and systems. Significant advantages of modular construction include performing the work in an enclosed facility protected from weather and the elements; efficiencies and improved quality arising from working in a factory setting with the assistance of tools and machinery that is not practical at an outdoor work site; and lower costs, shorter time to occupancy, and improved cash flow for the building owner resulting from these efficiencies and avoiding the need to hire skilled trade crews to work at the construction site.

Proper support for the individual modular units is vital to ensuring the assembled modular constructed building maintains its structural integrity over time and provides a safe and pleasant environment for its occupants. This support may be provided in various ways, including a slab on grade in which the modular units rest directly on a concrete slab at ground level, a below-grade basement or crawl space in which the modular units are supported by a foundation and vertical walls, or a "podium" in which the first floor is constructed using traditional non-modular building techniques and the modular units are placed on top of the first floor podium. Buildings constructed or assembled from modular units may include a single story or may be stacked on top of one another and side-by-side to create a structure several stories tall. In certain building designs, it may be desirable to create large open spaces. Examples from residential construction include living or recreational spaces in a single-family home or multi-family apartment building or condominium. In commercial construction, examples include areas such as lobbies, conference rooms, ballrooms, fitness areas, dinning areas, recreational areas, and indoor swimming pools where support structures including walls, columns, and piers would interfere with the activity taking place in the space, run array of architectural plans or detract from the aesthetics and visual appeal of the facility. Alternatives to walls, columns, and piers exist and may include structural elements like laminated wood beams or steel beams, girders, and trusses over the open space to provide support for the building structure above the open space. These alternatives are very expensive, require structural analysis to ensure their adequacy, and require costly crews, equipment, and time to install them properly while the building is being constructed.

The present disclosure concerns structures and methods to provide support contained within the buildout of a modular unit for spanning over large open spaces in a modular constructed building. While individual modular units used in modular building construction must be robustly constructed to withstand the rigors of being transported from the production facility to the construction site, the integration of a reinforcing structure during the building of a modular unit can further increase the rigidity and structural integrity and strength of the modular unit to the point where it no longer requires support from below and can span such large open spaces without disruptive walls, columns or piers or costly beams, girders, or trusses disposed beneath.

By building a reinforcing structure within the floor of an individual modular unit, the entire modular unit becomes a structural truss capable of spanning large open spaces without interior support elements from below. The reinforcing structure may take the form of single or multiple laminated lumbers, such as laminated veneer lumber (LVL) or parallel strand lumber (PSL), integrated into the floor structure of a modular unit. In one aspect, traditional bottom rim joists attached to floor trusses are configured with single or multiple laminated lumbers, depending on the structural rigidity needed in each modular unit. This structure withstands the tensile and compressive forces necessary to prevent the module from sagging downward, thereby eliminating the need for the aforementioned underlying supports such as walls, columns, piers, beams, girders, and trusses.

FIGS. 1-7 disclose exemplary aspects of a laminated lumber constructed modular unit 100 for modular building construction, where reinforcing structure takes the form of single or multiple laminated lumbers integrated into structural elements of the modular unit. The reinforcing structure may be integrated into the floor, walls, and roof In a preferred aspect, the reinforcing structure may be integrated into the floor. In a preferred aspect, the reinforcing structure may be integrated into the floor and wall. In one aspect, the reinforcing structure may be integrated into the roof. In another aspect, the reinforcing structure may be integrated into the roof and wall.

Modular unit 100 includes opposing walls 110 and 112 connected to an opposing floor 114, ceiling 116, and end walls 162, 164. Walls 110, 112 are framed from dimensional lumber such as 2×4s (e.g., for interior walls) or 2×6s (e.g., exterior walls) and include wall studs 118 connected between a top plate 120 and a bottom plate 122. Walls 110, 112 may include a single or double top plate 120, wall studs 118 and a single or double bottom plate 122 or sole plate. The interior side of walls 110 typically include an interior wall 124 of sheetrock and the exterior side of walls 110, 112 typically include an exterior wall 126, of one or more reinforcing structures, such as sheathing 168 with chipboard/particle board or oriented strand board (OSB). Walls 110, 112 may be framed to include one or more windows 127. Any suitable mechanism for constructing walls 110, 112 along with other features may be used, including bolts and nuts, lag bolts, screws, nails, and/or structural adhesives.

The ceiling 116 includes ceiling trusses 128 with a top chord 130 and bottom chord 132 connected by webs, such as a post 134 and diagonal 136. The interior side of ceiling 116 typically includes an interior ceiling 138 of sheetrock. Opposing top rim joists 140, 142 are connected to opposing ends of the ceiling trusses 128 and the top plate 120 of walls 110, 112 providing a reinforcing structure to the modular unit 100. Top rim joists 140, 142 can be constructed from dimensional lumber, such as doubled-up 2×10s or 2×12s. Any suitable mechanism for assembling ceiling 116, ceiling trusses 128, top rim joists 140, 142 and walls 110, 122 along with other features may be used, including bolts and nuts, lag bolts, screws, nails, and/or structural adhesives.

The floor 114 includes a floor truss 144 with a top chord 146 and bottom chord 148 connected by webs, such as a post 150 and diagonal 152. The interior side of floor 114 typically includes a subfloor 154 and finished floor 156. Other suitable sizes, arrangements and construction of floor trusses 144 are contemplated. For example, floor truss 144 may be constructed from two-by solid lumber, such as 2 inches by 8 inches, 2 inches by 10 inches, 2 inches by 12 inches, with various spacing. Other suitable sizes, arrangements and construction of the floor trusses 144 are also contemplated, such as, for example, a truss joist, I-joist, and a metal web system (e.g., Posi-Struts by MiTek). Opposing bottom one or multiple laminated lumbers 158, 160 are connected to opposing ends of the floor truss 144 and the bottom plate 122 of walls 110, 112 providing a reinforcing structure to the modular unit 100. One or multiple laminated lumbers 158, 160 can be constructed from laminated veneer lumber (LVL), such as, for example, 5¼ inch by 20 inches by 16 foot pieces of LVL staggered and offset across a full length (e.g., 65 feet) of the modular unit 100. Other suitable sizes, arrangements and construction of the LVL are contemplated), such as, for example, 1¾ inch by 11⅞ inches by 16 foot pieces of LVL stacked multiples together, staggered and offset across a full length of the modular unit 100 and 1¾ inch by 7¼ inches by 16 foot pieces of LVL stacked multiples together, staggered and offset across a full length of the modular unit 100. One or multiple laminated lumbers 158, 160 can be constructed from parallel strand lumber (PSL), such as, for example, 5½ inch by 22 inches by 16 foot pieces of PSL staggered and offset across a full length of the modular unit 100. Other suitable sizes, arrangements and construction of the PSL are contemplated. Although the one or multiple laminated lumbers 158, 160 are contemplated as being constructed from LVL and PSL. The present disclosure also contemplates construction from Glue Laminated Timber (Glulam), Cross-Laminated Timber (CLT), Nail Laminated Timber (NLT), Dowel Laminated Timber (DLT), and the like. The present disclosure also contemplates using solid lumber in place of the one or more laminated lumbers 158, 160. Any suitable mechanism for assembling floor 114, one or multiple laminated lumbers 158, 160 and walls 110, 112 along with other features may be used, including bolts and nuts, lag bolts, screws, nails, and/or structural adhesives.

The end walls 162, 164 are framed from dimensional lumber such as 2×4s or 2×6s and include wall studs 118 connected between a top plate 120 and a bottom plate 122. The interior side of walls 110 of end walls 162, 164 typically includes an interior wall 124 of sheetrock and the exterior side of end walls 162, 164 includes an exterior wall 126, of one or more reinforcing structures, such as sheathing 168 with chipboard/particle board or oriented strand board (OSB). End walls 162, 164 may be framed to include one or more windows 166. Any suitable mechanism for constructing walls 110, 112 and other features may be used, including bolts and nuts, lag bolts, screws, nails, and/or structural adhesives.

An assembled modular unit 100 includes, for example, opposing walls 110, 112 spaced apart by the ceiling 116 and floor 114 and enclosed by opposing end walls 162, 164. The one or more multiple laminated lumbers 158, 160 are configured as part of floor 114, are disposed parallel of each other on opposing sides of the modular unit 100 and run the entire length of the modular unit 100 between opposing end walls 162, 164. Thus, for example, opposing end walls 162, 164 can be mounted atop a foundation 204 and vertical walls 206, or a "podium" 202 in which the first floor is constructed using traditional non-modular building techniques creating a large open space beneath the unsupported span 161 of the modular unit that is unobstructed from and can span such large open spaces without disruptive walls, columns or piers or costly beams, girders, or trusses. The unsupported span 161 includes an unsupported portion 172 and a supported portion 174. The unsupported portion 172 extends between opposing supported portions 174. For example, vertical walls 206 of podium 202 provide the supported portion 174 underneath the one or more multiple laminate lumbers 158, 160. The unsupported portion 172 spans across the foundation 204 between opposing vertical walls 206 of the podium 202 providing the unsupported span 161 of the modular unit 100. In another aspect, depending on the design requirements for the modular unit constructed building 200, the one or multiple laminated lumbers 158, 160 have an unsupported span 161 that is configured to span unsupported portions of the floor 114 of the modular unit 100, using other types of reinforcement for supported portions of the floor 114. In another aspect, depending on the design requirements for the modular unit constructed building 200, the one or multiple laminated lumbers 158, 160 could be configured to span one or more portions of the ceiling or the entirety of the ceiling such as top rim joists 140, 142.

An assembled modular unit constructed building 200 includes, for example, modular units 100 set upon a slab on grade in which the modular units rest directly on a concrete slab at ground level, a below-grade basement or crawl space in which the modular units are supported by a foundation and vertical walls, or a "podium" in which the first floor is constructed using traditional non-modular building techniques and the modular units 100 are placed on top of the first floor podium.

Figure 6:
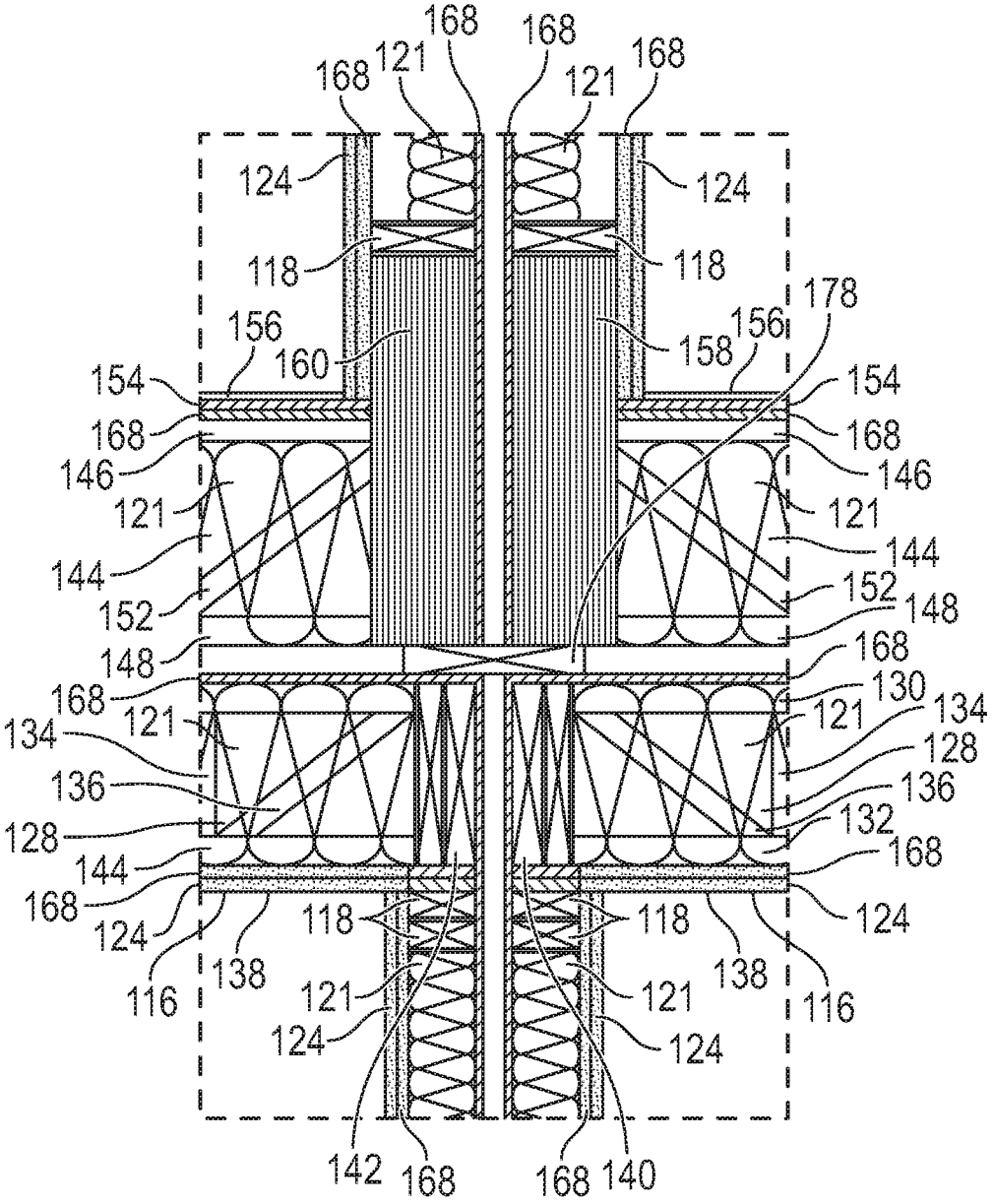
FIG. 6 is a section view of the modular constructed building taken along line 6-6 in FIG. 5 illustrating mating and connection between modular units in accordance with an exemplary aspect of the disclosure.
Figure 7:
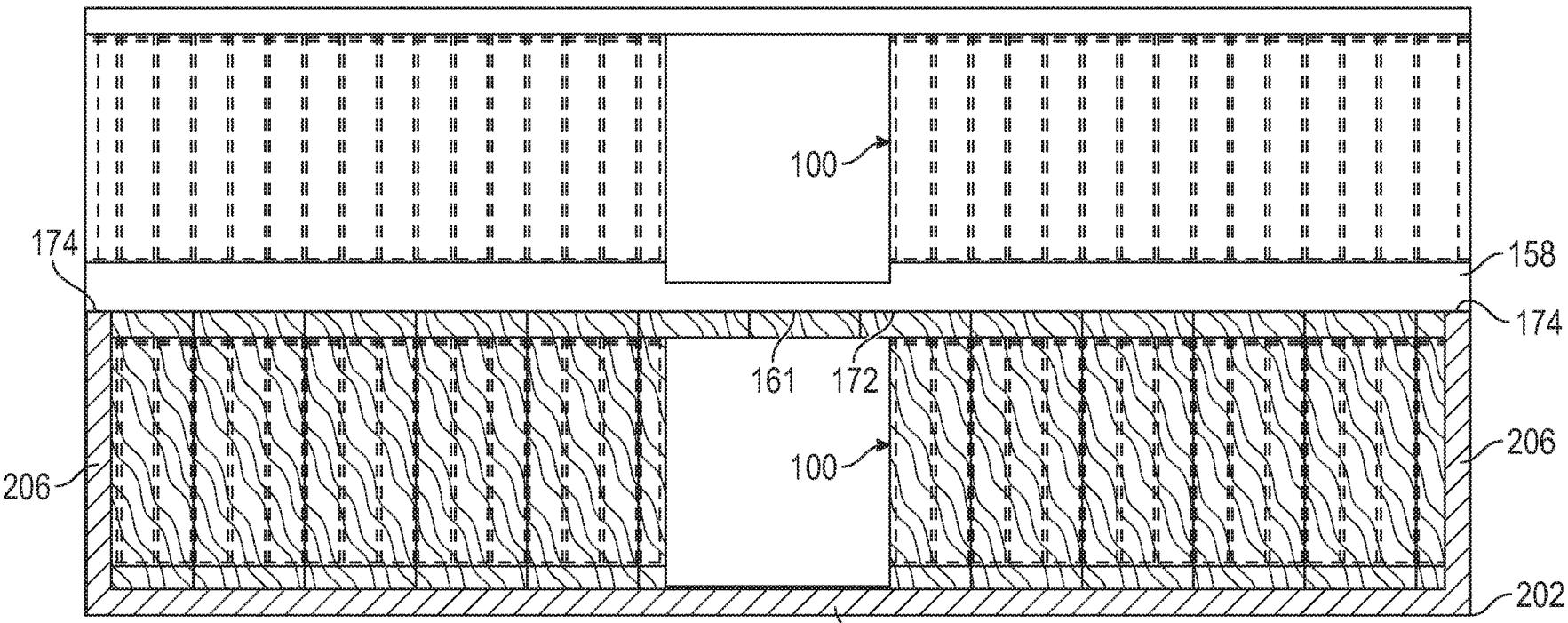
FIG. 7 is a cross-section view of the modular constructed building taken along line 7-7 in FIG. 5 illustrating a span of the volumetric unit above an open space within the modular constructed building in accordance with an exemplary aspect of the disclosure.

FIG. 6 provides an exemplary illustration for the orientation, mating and connection of at the floor 113 and walls 110, 112 of each modular unit 100 of the assembled modular unit constructed building 200. Adjoining floor 114 portions of modular units 100 are illustrated pictorially at the top of the figure. Adjoining ceiling 116 portions of the modular units 100 are illustrated pictorially at the bottom of the figure and discussed below. Left and right adjoining walls 110, 112 are framed from dimensional lumber such as 2×4s (e.g., for interior walls) or 2×6s (e.g., exterior walls) and include wall studs 118 connected between a top plate 120 and a bottom plate 122. The wall studs 118 may be spaced apart 16" on-center (O.C.). Insulation 121, such as sound attenuation batting (SAB) insulation or other suitable insulations, may be disposed within walls 110, 112, such as between wall studs 118. The interior side of walls 110 typically include an interior wall 124 of sheetrock, such as one or multiple layers of ⅝" gypsum wall board (GWB) and the exterior side of walls 110, 112 includes an exterior wall 126, of one or multiple reinforcing structures, such as sheathing 168 with chipboard/particle board or oriented strand board (OSB), such as 7/16" OSB sheathing 168.

End walls 162, 164 of each modular unit 100 may be framed to include one or more windows 127. Walls 110, 112 that are on the exterior of the modular unit constructed building 200 may also include one or more windows 127. Any suitable mechanism for constructing walls 110, 112 and other features may be used, including bolts and nuts, lag bolts, screws, nails, and/or structural adhesives.

The floor 114 of each adjoining modular unit 100 includes a floor truss 144 with a top chord 146 and bottom chord 148 connected by webs, such as a post 150 and diagonal 152. The floor truss 144 may be any type of floor truss, such as an 11⅞" floor truss spaced apart 16" O.C. or other suitable floor trusses and spacing. Other suitable sizes, arrangements and construction of floor trusses 144 are contemplated. For example, floor truss 144 may be constructed from two-by solid lumber, such as 2 inches by 8 inches, 2 inches by 10 inches, 2 inches by 12 inches, with various spacing. Other suitable sizes, arrangements and construction of the floor trusses 144 are also contemplated, such as, for example, a truss joist, I-joist, and a metal web system (e.g., Posi-Struts by MiTek). Insulation 121, such as sound attenuation batting (SAB) insulation, unfaced batting insulation or other suitable insulations, may be disposed within floors 114. The interior side of floor 114 typically includes a subfloor 154, such as 23/32" OSB or other suitable sheathing 168, and a finished floor 156, such as carpet, wood, linoleum, and tile. One or multiple laminated lumbers 158 are connected to the floor truss 144 and the bottom plate 122 of wall 110 and one or multiple laminated lumbers 160 are connected to the floor truss 144 and the bottom plate 122 of wall 112 thereby providing a reinforcing structure to each modular unit 100. One or multiple laminated lumbers 158, 160 can be constructed from laminated veneer lumber (LVL), such as, for example, 5¼ inch by 20 inches by 16 foot pieces of LVL staggered and offset across a full length (e.g., 65 feet) of the modular unit 100. Other suitable sizes, arrangements and construction of the LVL are contemplated), such as, for example, 1¾ inch by 11⅞ inches by 16 foot pieces of LVL stacked multiples together, staggered and offset across a full length of the modular unit 100 and 1¾ inch by 7¼ inches by 16 foot pieces of LVL stacked multiples together, staggered and offset across a full length of the modular unit 100. One or multiple laminated lumbers 158, 160 can be constructed from parallel strand lumber (PSL), such as, for example, 5½ inch by 22 inches by 16 foot pieces of PSL staggered and offset across a full length of the modular unit 100. Other suitable sizes, arrangements and construction of the PSL are contemplated. Although the one or multiple laminated lumbers 158, 160 are contemplated as being constructed from LVL and PSL. The present disclosure also contemplates construction from Glue Laminated Timber (Glulam), Cross-Laminated Timber (CLT), Nail Laminated Timber (NLT), Dowel Laminated Timber (DLT), and the like. The present disclosure also contemplates using solid lumber in place of the one or more laminated lumbers 158, 160. Any suitable mechanism for assembling floor 114, one or multiple laminated lumbers 158, 160 and walls 110, 112 along with other features may be used, including bolts and nuts, lag bolts, screws, nails, and/or structural adhesives.

FIG. 6 also provides an exemplary illustration for the orientation, mating and connection at the ceiling 116 and walls 110, 112 of each modular unit 100 of the assembled modular unit constructed building 200. Adjoining ceiling 116 portions of the modular units 100 are illustrated pictorially at the bottom of the figure. Adjoining floor 114 portions of modular units 100 are illustrated pictorially at the top of the figure and discussed above. Left and right adjoining walls 110, 112 are framed from dimensional lumber such as 2×4s (e.g., for interior walls) or 2×6s (e.g., exterior walls) and include wall studs 118 connected between a top plate 120 and a bottom plate 122. The wall studs 118 may be spaced apart 16" on-center (O.C.). Insulation 121, such as sound attenuation batting (SAB) insulation or other suitable insulations, may be disposed within walls 110, 112, such as between wall studs 118. The interior side of walls 110 typically include an interior wall 124 of sheetrock, such as one or multiple layers of ⅝" gypsum wall board (GWB) and the exterior side of walls 110, 112 includes an exterior wall 126, of one or multiple reinforcing structures, such as sheathing 168 with chipboard/particle board or oriented strand board (OSB), such as 7/16" OSB sheathing 168.

End walls 162, 164 of each modular unit 100 may be framed to include one or more windows 127. Walls 110, 112 that are on the exterior of the modular unit constructed building 200 may also include one or more windows 127. Any suitable mechanism for constructing walls 110, 112 and other features may be used, including bolts and nuts, lag bolts, screws, nails, and/or structural adhesives.

The ceiling 116 of each adjoining modular unit 100 includes ceiling trusses 128 with a top chord 130 and bottom chord 132 connected by webs, such as a post 134 and diagonal 136. The ceiling trusses 128 may be any type of ceiling truss, such as a 9¼" ceiling trusses spaced apart 24" O.C. or other suitable ceiling trusses and spacing. Insulation 121, such as faced/unfaced batting insulation, sound attenuation batting (SAB) insulation, or other suitable insulations, may be disposed within ceiling 116. The interior side of ceiling 116 typically includes an interior ceiling 138 of sheetrock, such as one or multiple layers of ⅝" gypsum wall board (GWB) or other suitable wall boards. Top rim joist 142 of the left modular unit 100 are connected to the ends of the ceiling trusses 128 and the top plate 120 of wall 112 providing a reinforcing structure to the left modular unit 100. Similarly, top rim joist 140 of the right modular unit 100 are connected to the ends of the ceiling trusses 128 and the top plate 120 of wall 110 providing a reinforcing structure to the right modular unit 100. Top rim joists 140, 142 can be constructed or assembled from dimensional lumber, such as doubled-up 2×10s or 2×12s, or other suitable lumber. Any suitable mechanism for assembling ceiling 116, ceiling trusses 128, top rim joists 140, 142 and walls 110, 112 along with other features may be used, including bolts and nuts, lag bolts, screws, nails, and/or structural adhesives.

FIG. 6 also provides an exemplary illustration for the orientation, mating and connection at the ceiling 116 and floor 114 of each modular unit 100 of the assembled modular unit constructed building 200. In one aspect, a crush plate 178 constructed from dimensional lumber, such as 2×8s, 2×10s, 2×12s, or other suitable dimensions, is disposed between the ceilings 116 and floors 114 of modular units 100 assembled together into a modular unit constructed building 200. Crush plate 178, also known as an anti-crush plate, are generally used to avoid crushing of the lumber at supports of heavily loaded lumber trusses on wall frames. Crush plate 178 accomplishes this by increasing the width of the bearing and therefore the bearing capacity. Crush plate 178 is typically disposed underneath the one or more multiple laminated lumbers 160 of the left modular unit 100, underneath the one or multiple laminated lumbers 158 of the right modular unit 100, above the top rim joist 142 of the left modular unit 100, above the top rim joist 140 of the right modular unit, and spanning a gap 170 between both the left and right modular units 100. Modular units 100 are assembled together so common features align, such as a hallway 170, breezeway or corridor. Any suitable mechanism for assembling the crush plate 178, the one or more multiple laminated lumbers 160 of the left modular unit 100, the one or multiple laminated lumbers 158 of the right modular unit 100, the top rim joist 142 of the left modular unit 100, and the top rim joist 140 of the right modular unit, along with other features may be used, including bolts and nuts, lag bolts, screws, nails, and/or structural adhesives.

The invention is not to be limited to the particular aspects described herein. In particular, the disclosure contemplates numerous variations in a laminated lumber constructed modular unit for modular building construction, as best illustrated in FIGS. 1-7. The foregoing description has been presented for purposes of illustration and description. It is not intended to be an exhaustive list or limit any of the invention to the precise forms disclosed. It is contemplated that other alternatives or exemplary aspects are considered included in the disclosure. The description is merely examples of embodiments, processes or methods of the invention. It is understood that any other modifications, substitutions, and/or additions can be made, which are within the intended spirit and scope of the disclosure.

What is claimed is:

1. A laminated lumber constructed volumetric modular unit constructed at a modular unit factory and shipped assembled to a modular building project site, the laminated lumber constructed volumetric modular unit comprising:

a floor structure and ceiling structure interconnected by opposing side wall structures and opposing end wall structures;

a plurality of floor trusses disposed within the floor structure;

a plurality of ceiling trusses disposed within the ceiling structure;

a plurality of wall studs disposed within the opposing side wall structures and opposing end wall structures;

one or more rim joists attached to the ceiling structure atop of the plurality of wall studs; and one or more multiple laminated lumbers attached to the floor structure and extending between the opposing end wall structures for carrying the load of the volumetric modular unit, wherein the one or more multiple laminated lumbers have opposing top and bottom edges;

wherein the one or more multiple laminated lumbers form a portion of the opposing side wall structures and wherein a lower most portion of the opposing side wall structures abuts the top edge of the one or more multiple laminated lumbers above the floor structure.

2. The laminated lumber constructed volumetric modular unit of claim 1, further comprising:

a first one or more multiple laminated lumbers attached to a first end of the plurality of floor trusses.

3. The laminated lumber constructed volumetric modular unit of claim 1, further comprising:

a second one or more multiple laminated lumbers attached to a second end of the plurality of floor trusses.

4. The laminated lumber constructed volumetric modular unit of claim 1, further comprising:

at least one bottom plate of the opposing side wall structures attached to the one or more multiple laminated lumbers and plurality of wall studs.

5. The laminated lumber constructed volumetric modular unit of claim 1, further comprising:

one or more layers of sheathing attached to the one or more multiple laminated lumbers and the opposing side wall structures.

6. The laminated lumber constructed volumetric modular unit of claim 1, further comprising:

a first end of the one or more multiple laminated lumbers attached to a first one of the opposing end wall structures and a second end of the one or more multiple laminated lumbers attached to a second one of the opposing end wall structures.

7. The laminated lumber constructed volumetric modular unit of claim 1, wherein the one or more multiple laminated lumbers comprise laminated veneer lumber.

8. A modular building constructed from laminated lumber constructed volumetric modular unit, the modular building comprising:

a foundation with opposing foundation walls forming an open space extending entirely between the opposing foundation walls;

a plurality of volumetric modular units assembled together on top of the foundation to provide the modular building having one or more floors with one or more rooms;

at least one of the plurality of volumetric modular units having:

a floor structure and ceiling structure interconnected by opposing side wall structures and opposing end wall structures;

a plurality of floor trusses disposed within the floor structure;

a plurality of ceiling trusses disposed within the ceiling structure;

a plurality of wall studs disposed within the opposing side wall structures and opposing end wall structures;

one or more rim joists attached to the ceiling structure; and one or more multiple laminated lumbers attached to the floor structure and extending between the opposing end wall structures for carrying the load of the modular unit, wherein the one or more multiple laminated lumbers form a portion of the opposing side wall structures extending above the floor structure;

a first supported end of the one or more multiple laminated lumbers supported atop a first one of the opposing foundation walls and a second supported end of the one or more multiple laminated lumbers supported atop a second one of the opposing foundation walls; and an unsupported portion of the one or more multiple laminated lumbers extending between the first and second supported ends above the open space.

9. The modular building of claim 8, further comprising:

a first one or more multiple laminated lumbers attached to a first end of the plurality of floor trusses and a second one or more multiple laminated lumbers attached to a second end of the plurality of floor trusses.

10. The modular building of claim 8, wherein the first supported end of the one or more multiple laminated lumbers is attached to a first one of the opposing end wall structures and the second supported end of the one or more multiple laminated lumbers attached to a second one of the opposing end wall structures.

11. The modular building of claim 8, further comprising:

a first and second volumetric modular unit of the plurality of volumetric modular units assembled side by side on the one or more floors, wherein the one or more multiple laminated lumbers of the first volumetric modular unit is coplanar with the one or more multiple laminated lumbers of the second volumetric modular unit.

12. The modular building of claim 11, wherein the one or more multiple laminated lumbers of the first volumetric modular unit is contiguous with the one or more multiple laminated lumbers of the second volumetric modular unit.

13. The modular building of claim 8, further comprising:

a crush plate disposed between the one or more multiple laminated lumbers of a first and second volumetric modular unit assembled side by side on a second of the one or more floors and the one or more rim joists of the ceiling structure of a first and second volumetric modular unit assembled side by side on a first one of the one or more floors.

14. The modular building of claim 8, further comprising:

one or more layers of sheathing attached to the one or more multiple laminated lumbers and the opposing side wall structures.

* * * * *